US005798198A

United States Patent [19]

Sukovich et al.

[11] Patent Number: 5,798,198

[45] Date of Patent: Aug. 25, 1998

[54] NON-STOICHIOMETRIC LITHIUM FERRITE CARRIER

[75] Inventors: Alan Sukovich; William R. Hutcheson, both of Valparaiso, Ind.

[73] Assignee: Powdertech Corporation, Valparaiso, Ind.

[21] Appl. No.: 555,909

[22] Filed: Nov. 13, 1995

Related U.S. Application Data

[63] Continuation-in-part of Ser. No. 45,379, Apr. 9, 1993, abandoned.

[51] Int. Cl.[6] ..... G03G 9/107; G03G 9/113

[52] U.S. Cl. ..... 430/106.6; 430/109; 252/62.61

[58] Field of Search ..... 430/106.6, 108; 423/594, 641; 252/62.61

[56] References Cited

U.S. PATENT DOCUMENTS

| | | | |
|---|---|---|---|
| 2,618,552 | 11/1952 | Wise | 95/1.9 |
| 2,846,333 | 8/1958 | Wilson | 117/17.5 |
| 2,874,063 | 2/1959 | Greig | 117/17.5 |
| 3,079,342 | 2/1963 | Insalaco | 252/62.1 |
| 3,099,943 | 8/1963 | Eichorn et al. | 95/1.7 |
| 3,370,011 | 2/1968 | Kitagawa et al. | 252/62.61 |
| 3,590,000 | 6/1971 | Palermiti et al. | 252/62.1 |
| 3,900,587 | 8/1975 | Lenhard et al. | 427/19 |
| 3,929,657 | 12/1975 | Jones | 252/62.61 P |
| 3,989,648 | 11/1976 | Lenhard et al. | 252/62.1 |
| 4,040,969 | 8/1977 | Jones | 252/62.61 R |
| 4,192,902 | 3/1980 | Lu | 427/127 |
| 4,485,162 | 11/1984 | Imamura et al. . | |
| 4,598,034 | 7/1986 | Honjo et al. | 430/106.6 |
| 4,618,556 | 10/1986 | Takenouchi et al. | 430/110 |
| 4,623,603 | 11/1986 | Iimura et al. . | |
| 4,663,262 | 5/1987 | Oka et al. | 430/108 |
| 4,698,289 | 10/1987 | Aldrich et al. | 430/106.6 |
| 4,741,984 | 5/1988 | Imai et al. | 430/106.6 |
| 4,751,164 | 6/1988 | Katayama et al. | 430/137 |
| 4,822,708 | 4/1989 | Machida et al. | 430/106.6 |

(List continued on next page.)

FOREIGN PATENT DOCUMENTS

| | | |
|---|---|---|
| 40-25467 | 11/1965 | Japan . |
| 54-34156 | 10/1979 | Japan . |
| A59127054 | 7/1984 | Japan . |
| A61200551 | 9/1986 | Japan . |
| 1-119520 | 5/1989 | Japan . |
| 385328 | 5/1973 | U.S.S.R. . |
| WO9205475 | 4/1992 | WIPO . |

OTHER PUBLICATIONS

R.C. MacKenzie, "Differential Thermal Analysis," V.1, p. 333, Academic Press, New York 1970, pp. 332–334.

Inorganic Materials, vol. 8, No. 3, Mar., 1972, pp. 439–442.

IEEE Transactions on Magnetics, Mar., 1972, pp. 83–94.

G. Bandyopadhyay and R. M. Fulrath, "Thermogravimetry of Lithium Spinel Ferrites," J.Am.Ceram.Soc., 57[4] 483–86 (1974) pp. 483–486.

J.J. Green and H. J. Van Hook, "Microwave Properties of Lithium Ferrites," IEEE Trans. Microwave Theory Tech. MTT-25 [2] 155–59 (1977).

E.A. Kuchinskaya, et al., "Effect of Bismuth Oxide on the Phase Composition and Magnetic Properties of the $12Fe_2O_3$ 3 BaO 2 CoO System," vol. 16, No. 11 (179), Nov., 1977.

W. Simonet and A. Hermosin, "Soft Li–Ti–Zn Ferrites with Resistivity >$10^8$OHM.CM," IEEE Trans. Magn., Mag–14 [4] 903–905 (1978).

Materials Research Bulletin, Sep., 1980, Perqzmon Press, vol. 15, No. 9, pp. 1199–1205.

(List continued on next page.)

*Primary Examiner*—Christopher D. Rodee
*Attorney, Agent, or Firm*—Banner & Wticoff, Ltd.

[57] ABSTRACT

A non-stoichiometric lithium ferrite powder having a compositional range represented by the formula:

$$[(Li_2O)_{0.25}(Fe_2O_3)_{0.25}]_x(Fe_2O_3)_{1.00-x}$$

where $0.35<x\leq 0.50$ mole fraction provides an environmentally safe carrier.

6 Claims, 9 Drawing Sheets

U.S. PATENT DOCUMENTS

| | | | |
|---|---|---|---|
| 4,855,205 | 8/1989 | Saha et al. | 430/106.6 |
| 4,879,198 | 11/1989 | Tavernier et al. | 430/106.6 |
| 4,898,801 | 2/1990 | Tachibana et al. | 430/106.6 |
| 4,937,166 | 6/1990 | Creatura et al. | 430/108 |
| 4,971,880 | 11/1990 | Hotomi et al. | 430/108 |
| 5,004,665 | 4/1991 | Ohtani et al. | 430/106.6 |
| 5,116,711 | 5/1992 | Kobayashi et al. | 430/106 |
| 5,124,223 | 6/1992 | Yoerger | 430/106.6 |
| 5,149,610 | 9/1992 | Kobayashi et al. | 430/106 |
| 5,162,187 | 11/1992 | Lyons et al. | 430/106.6 |
| 5,180,649 | 1/1993 | Kukimoto et al. | 430/106.6 |
| 5,194,356 | 3/1993 | Sacripante et al. | 430/106.6 |
| 5,204,204 | 4/1993 | Shintani et al. | 430/108 |
| 5,206,109 | 4/1993 | Anno | 430/137 |
| 5,212,034 | 5/1993 | Tsuyama et al. | 430/108 |
| 5,212,039 | 5/1993 | Demizu et al. | 430/122 |
| 5,422,216 | 6/1995 | Smith et al. | 430/108 |
| 5,466,552 | 11/1995 | Sato et al. | 430/106.6 |
| 5,518,849 | 5/1996 | Sato et al. | 430/108 |

OTHER PUBLICATIONS

Jen-Yan Hsu, et al., "Low Temperature Fired NiCuZn Ferrite," IEEE Transactions on Magnetics, vol. 30, No. 6, Nov., 1994.

Advances in Ceramics, vol. 15, Fourth International Conference on Ferrite, Part 1, pp. 207–213, (1985).

1" = 0.02" INCHES

1" = 0.005" INCHES

1" = 0.02" INCHES

1" = 0.005" INCHES

1" = 0.02" INCHES

1" = 0.005" INCHES

1" = 0.02" INCHES

1" = 0.005" INCHES

1" = 0.02" INCHES

1" = 0.005" INCHES

NON-STOICHIOMETRIC LITHIUM FERRITE CARRIER

CROSS REFERENCE TO RELATED APPLICATION

This is a continuation-in-part application to Ser. No. 08/045,379 filed Apr. 9, 1993 now abandoned for which priority is claimed.

BACKGROUND OF THE INVENTION

The present invention relates to a magnetic carrier for use with electrophotographic development equipment and, more particularly, to an environmentally benign lithium ferrite carrier having a non-stoichiometric composition.

Carriers in the form of powder are used to transfer toner particles in electrophotographic development equipment, for example, in photocopying machines and most recently in laser printers. Typically, such carriers are ferrites or ferrite powders in combination with various metals, for example, nickel, zinc, or copper. Numerous patents have issued directed to various ferrite carrier compositions including the following: Iimura et al., U.S. Pat. No. 4,623,603; Honjo et al., U.S. Pat. No. 4,598,034; Tachibana et al., U.S. Pat. No. 4,898,801, Imamura et al., U.S. Pat. No. 4,485,162; and Jones, U.S. Pat. No. 3,929,657.

The prior art patents teach both single component and dual component ferrite carriers. These patents also teach various crystalline structures for the carriers. In general, these patents teach the utilization of stoichiometric compositions of the various metals with ferrites. Additionally, these patents teach various processes for the manufacture of such carriers.

The research with respect to such carriers has been an ongoing effort and most recently it has been recognized that many ferrite carrier powders are produced with compositions that contain elements that may be regarded as hazardous to the environment, such as the metals: nickel, copper and zinc. Thus, there has developed a need to provide an environmentally benign carrier which may be safely and easily disposed once it has served a useful life. The present invention is directed to an environmentally safe carrier which is also an efficient and effective substitute for prior art carriers not considered to be as environmentally safe.

SUMMARY OF THE INVENTION

In a principal aspect, the present invention comprises a carrier for electrophotographic developing comprising a generally non-stoichiometric lithium ferrite powder having a particular compositional range. The carrier has a substantially spinel crystalline structure and may be formed in a generally spherical shaped magnetic core configuration for use in pre-existing conventional electrophotographic equipment.

Thus it is an object of the invention to provide an improved electrophotographic development carrier material which is environmentally safe or benign.

It is a further object of the invention to provide an electrophotographic carrier which is as useful as prior art carriers that incorporate other metal elements.

Yet another object of the invention is to provide an electrophotographic carrier which is a non-stoichiometric lithium ferrite compound.

A further object of the invention is to provide a lithium ferrite powder for use as a carrier having a form and being in a condition for use with electrophotographic equipment already in service.

Another object of the invention is to provide an electrophotographic development carrier comprised of lithium ferrites having a range of composition.

Yet a further object of the invention is to provide a method for manufacture of a lithium ferrite carrier having a spinel crystalline structure and which is useful in electrophotographic processes.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

The present invention comprises a generally spherical shaped, magnetic carrier core powder which may be used for magnetic brush development in copy machines and laser printers. As taught in prior art patents such as those referenced above, magnetic carriers such as ferrites are used to transfer toner particles from a developer mix onto a photoreceptor. The particles are then transferred by the photoreceptor onto plain paper. The ferrite carrier powders are typically in the form of spherical beads or powder which may or may not be coated with resin. Also typically the ferrites are combined with various metal oxides which enhance the utility of the carrier powder.

The present invention is a magnetic ferrite carrier powder which does not contain elements considered potentially hazardous such as nickel, copper, zinc and barium. Thus, the present invention comprises a generally non-stoichiometric lithium ferrite.

Stoichiometric lithium ferrite composition may be represented by the following formulation:

$$(Li_2O)_{0.25}\ (Fe_2O_3)_{0.25}\ Fe_2O_3$$

Other ways of representing the stoichiometric formulation of the lithium ferrite composition include the following:

1. $LiFe_5O_8$, or
2. $Li_2O \cdot 5\ Fe_2O_3$

Lithium is monovalent and thus requires an equal molar amount of trivalent iron to obtain the desired spinel crystalline structure as a ferrite. Consequently, the formulas set forth above represent the stoichiometric composition of lithium ferrite.

Figure 1:
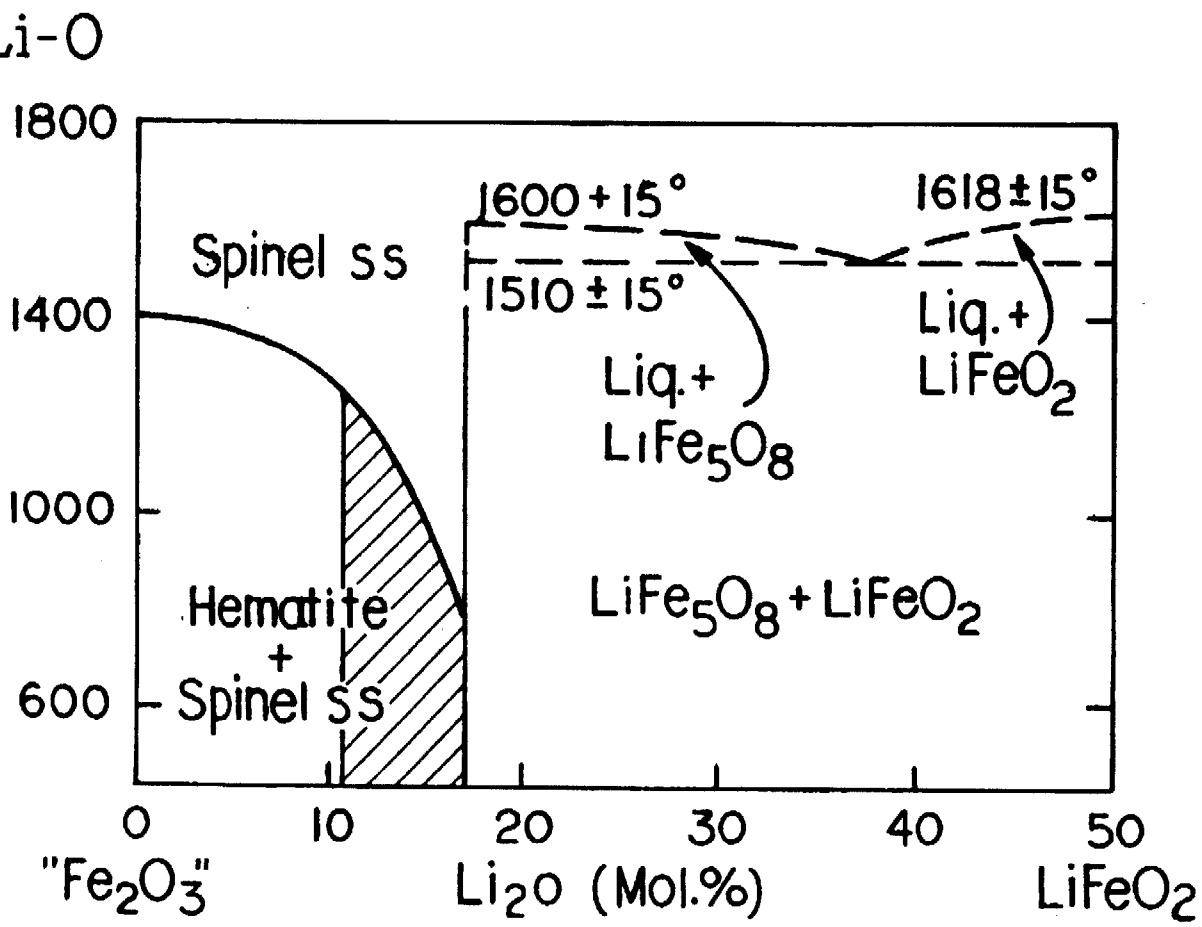
FIG. 1 is a phase diagram for lithium ferrite compositions illustrating the range of the composition of the carrier of the present invention which is entirely non-stoichiometric.

By contrast, the compositional range which is preferred or which is specified as comprising the present invention is represented by the following generally non-stoichiometric relationship:

$$[(Li_2O)_{0.25}(Fe_2O_3)_{0.25}]_x(Fe_2O_3)_{1.00-x}$$

where $0.35<x\leqq 0.50$ mole fraction. Referring to FIG. 1, this composition range is represented by the cross-hatched portion of the ferrite/lithium ferrite phase diagram. The desired formulation of such a lithium ferrite powder material which constitutes a carrier has a spinel structure, is environmentally safe, and has the necessary characteristics to serve as an excellent carrier. Generally, the composition is prepared by the following sequential steps:

1. Lithium carbonate or lithium oxide is mixed with iron oxide in the amounts prescribed by the compositional formula set forth above. The two compounds are intensely mixed by a wet or dry method.
2. The mixture of oxides is calcined to a temperature between 700° and 1100° C. as an optional step to prereact the mixture.
3. Calcined material or oxides from steps 1 and/or 2 are milled with water as a slurry in a milling unit such as an attritor or ball mill. To this slurry binders and deflocculants are added. Sintering aids may also be added to assist in densification and strength properties. Various other additives such as $SiO_2$, $Bi_2O_3$, are typically added in amounts from 0.001 up to about 0.05 weight fraction which amounts constitute minor amounts. The $SiO_2$ additive has the effect of improving strength of the sintered core. The $Bi_2O_3$ has the effect of lowering sintering temperature. This milling operation is ended when a desired particle size is achieved. Both additives locate in the grain boundary and do not participate in the spinel structure.
4. Slurry from the milling operation is spray dried to produce specified sized spheres referred to as beads. This operation is performed in a typical spray dryer using rotary or nozzle atomization.
5. Spray dried powder is screened to a specific size distribution in the green state. This operation is typically performed using a vibratory screening device.
6. Green screened product from the screening operation is sintered in a furnace or kiln in an atmosphere containing 21% $O_2$ capable of reaching temperatures of 1000° C. to 1300° C. The degree of sintering depends upon the type of surface texture and apparent density desired.
7. The powder is cooled at a predetermined rate to assist in achieving the desired magnetic moment.
8. The fired powder typically exhibits some degree of bead to bead fusion and is, accordingly, deagglomerated with a hammer type of mill.
9. Deagglomerated powder is screened to a specific size distribution. Air classification may be used for separation or screening finer particle distributions.
10. Magnetic separation may be performed as an option to ensure that no non-magnetic particles are contained in the powder product.
11. The final sintered powder may be coated with a resin coating to assist in the attainment of the desired reprographic properties.

The present invention produces carriers with a variety of magnetic properties which may be used in different applications of magnetic brush development. The range of magnetic moment of the powder is about 30–65 electromagnetic units per gram (emu/g). The following is a table which sets forth the range of magnetic saturation as it correlates with the composition, for very slow cooling from sintering temperature conditions.

TABLE 1

| Mole Composition | Magnetic Saturation EMU/g (4000 Oe drive field) |
|---|---|
| $[(Li_2O)_{.25}(Fe_2O_3)_{.25}]_{.50}(Fe_2O_3)_{.50}$ or $(Li_2O)_{.167}(Fe_2O_3)_{.833}$ | 61.4 |
| $[(Li_2O)_{.25}(Fe_2O_3)_{.25}]_{.46}(Fe_2O_3)_{.54}$ or $(Li_2O)_{.149}(Fe_2O_3)_{.851}$ | 60.6 |
| $[(Li_2O)_{.25}(Fe_2O_3)_{.25}]_{.42}(Fe_2O_3)_{.58}$ or $(Li_2O)_{.133}(Fe_2O_3)_{.867}$ | 44.4 |
| $[(Li_2O)_{.25}(Fe_2O_3)_{.25}]_{.38}(Fe_2O_3)_{.62}$ or $(Li_2O)_{.123}(Fe_2O_3)_{.877}$ | 33.4 |

Set forth below are some specific examples of the lithium oxide ferrite carrier of the present invention, and a comparison thereof to typical commercially produced CuZn and NiZn ferrite materials. The carrier compositions are within the mole percentage range set forth in FIG. 1 for the lithium oxide ferrite mixtures. The example carriers are thus of the nature and have a crystalline structure which is principally a spinel structure.

Example No. 1 - Lithium ferrite according to the formulation $(Li_2O)_{0.1521}(Fe_2O_3)_{0.8479}$ was prepared. Specifically, batch mixtures of 100 pounds including 7.67% by weight lithium carbonate and 92.33% by weight iron oxide were mixed.

The batches were intensively dry mixed in an Eirich R-7 mixer/pelletizer. After pelletization, two (2) gallons of water was added to minimize dusting and promote pelletization of the raw oxides and carbonates. The pellets were oven dried and calcined in a batch electric kiln for four (4) hours at 1010° C.

Calcined pellets were charged to a batch type steel ball grinding mill and milled six (6) hours, with the following additives:

TABLE 2

| | |
|---|---|
| 400 lbs. | Calcinate |
| 18 gallons | Water |
| 2 lbs. | Wetting Agent (Dispex A-40 by Allied Colloids) |
| 2 lbs. | $SiO_2$ (Syloid 244 by WR Grace) |

After appropriate milling, twenty (20) lbs. of a 10% by weight polyvinyl alcohol (PVA) solution was added to the slurry to promote binding of the beads during spray drying. Airvol 205S brand of PVA was used. The slurry produced was nozzle atomized in a single fluid pressure nozzle type of dryer, using an 0.046 inch diameter orifice at 350psi to generate the appropriate bead size. Spray dried powder or beads resulting therefrom was classified using a 48" diameter Sweco brand vibratory separator with the acceptable mesh fraction being −120 TBC Mesh, +200 TBC Mesh (−149μ+88μ).

Figure 2:
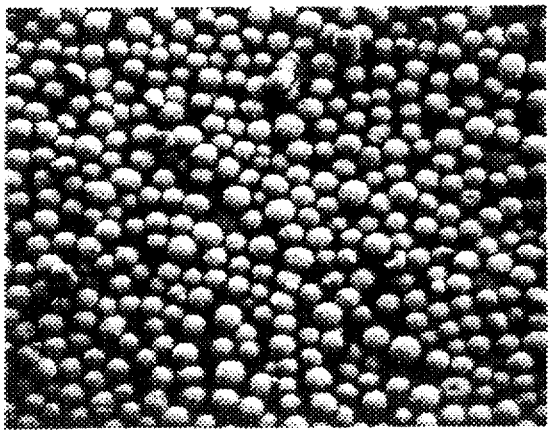
FIG. 2 is a photomicrograph of the carrier of Example No. 1 of the invention at 50× magnification.
Figure 3:
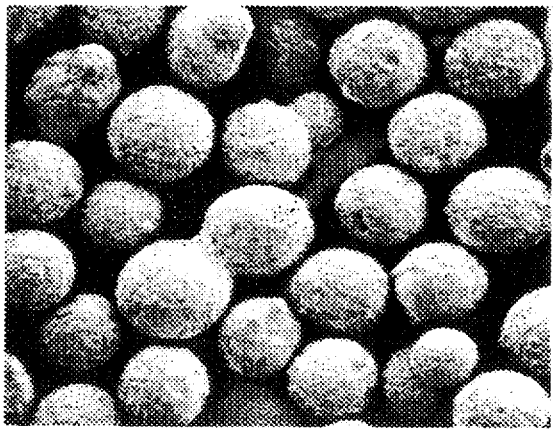
FIG. 3 is a photomicrograph of the carrier of Example No. 1 of the invention at 200× magnification.

The resulting product was sintered at about 1165° C. for seven (7) hours in an air atmosphere in an electric fired batch kiln. Refractory boats were used to contain the powder during sintering. The kiln was allowed to cool naturally by shutting off the power at the end of the cycle. The resultant powder cake was deagglomerated in a hammer type mill, and product again screened in a 48" Sweco vibratory separator −145 TBC Mesh, +250 Market Grade Mesh (−125μ+63μ). The resultant carrier powder was then tested to determine its properties. Typical reprographic test properties are listed in Table 3. FIGS. 2 and 3 depict the physical appearance of the carrier at 50 and 200 magnification utilizing a scanning electron microscope (SEM). The separate core elements are noted to be generally uniform in size and spherical.

Figure 4:
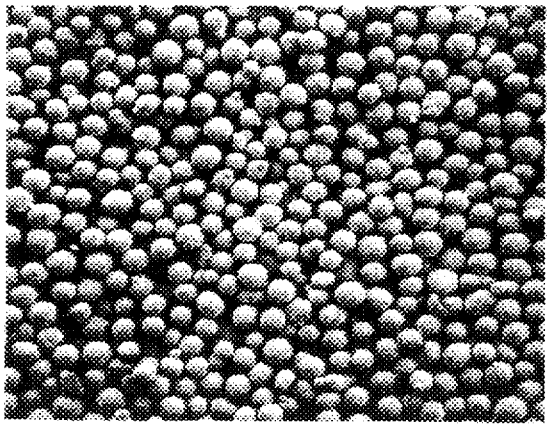
FIG. 4 is a photomicrograph of the carrier of Example No. 2 of the invention at 50× magnification.
Figure 5:
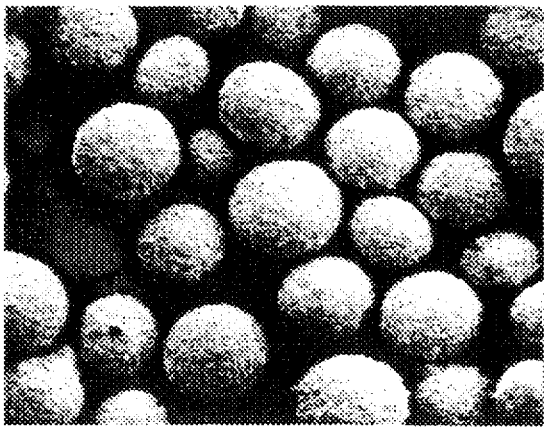
FIG. 5 is a photomicrograph of the carrier of Example No. 2 of the invention at 200× magnification.

Example No. 2 - Lithium ferrite according to the formulation $(Li_2O)_{0.145}(Fe_2O_3)_{0.855}$ was produced using processing similar to that in Example No. 1. The resulting test properties are listed in Table 3. FIGS. 4 and 5 depict the physical appearance of the carrier in a SEM photomicrograph at 50 and 200 magnifications. These core elements are generally spherical and uniform in shape.

Figure 6:
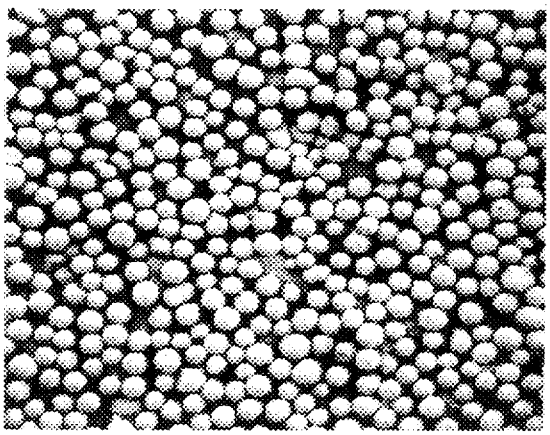
FIG. 6 is a photomicrograph of the carrier of Example No. 3 of the invention at 50× magnification.
Figure 7:
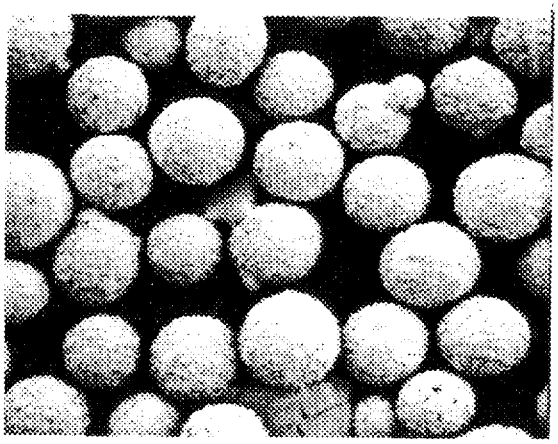
FIG. 7 is a photomicrograph of the carrier of Example No. 3 of the invention at 200× magnification.

Example No. 3 - Copper zinc ferrite of the formulation $(CuO)_{0.20}(ZnO)_{0.11}(Fe_2O_3)_{0.69}$ was produced using processing like that of Example No. 1 with the exception that the calcine temperature was 790° C. and final sintering temperature was 1300° C. Measured test properties are listed in Table 3. FIGS. 6 and 7 are SEM photomicrographs of the described prior art carrier and is offered for purposes of comparison to the carrier of Example No. 1 and No. 2. The size, shape and appearance is very similar to the lithium ferrite carriers.

Figure 8:
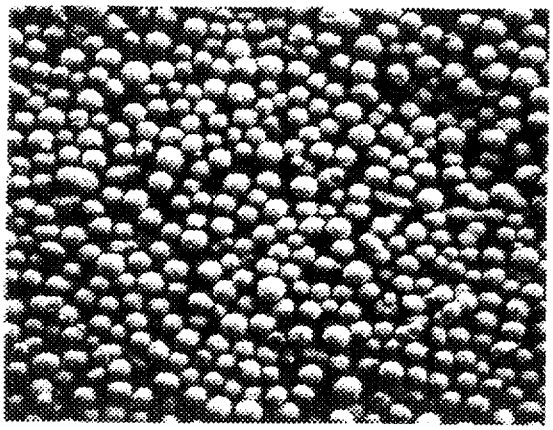
FIG. 8 is a photomicrograph of the carrier of Example No. 4 of the invention at 50× magnification.
Figure 9:
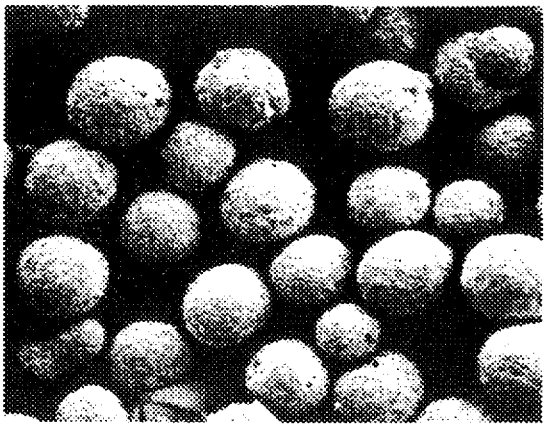
FIG. 9 is a photomicrograph of the carrier of Example No. 4 of the invention at 200× magnification.

Example No. 4 - Copper zinc ferrite of the formulation $(CuO)_{0.20}(ZnO)_{0.25}(Fe_2O_3)_{0.55}$ was prepared using similar processing as in Example No. 1 with the exception that the calcining temperature was 790° C. and the final sintering temperature was 1160° C. Measured test properties are also listed in Table 3. FIGS. 8 and 9 are SEM photomicrographs of another prior art formulation for a carrier and for purposes of comparison should be evaluated in relation to FIGS. 2 through 7. Again the comparison is one of high similarity.

Figure 10:
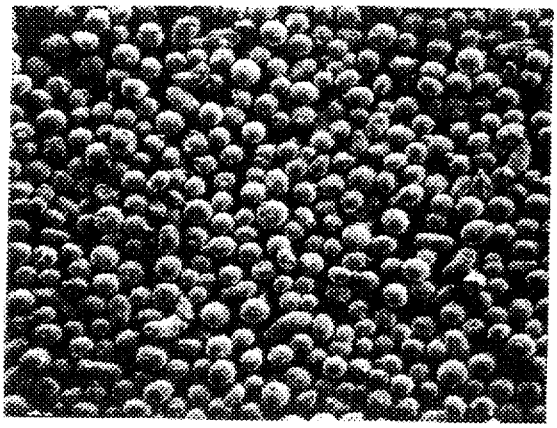
FIG. 10 is a photomicrograph of the carrier of Example No. 5 of the invention at 50× magnification.
Figure 11:
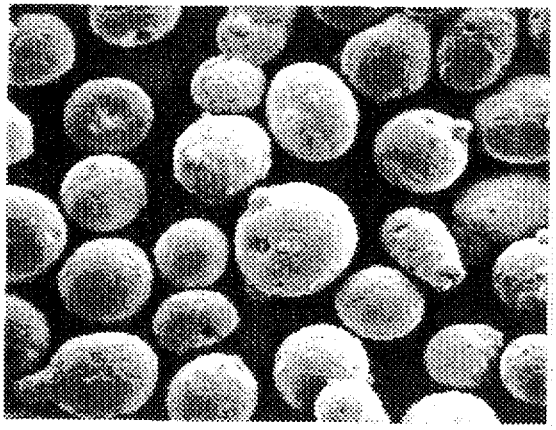
FIG. 11 is a photomicrograph of the carrier of Example No. 5 of the invention at 200× magnification.

Example No. 5 - Nickel zinc ferrite of the formulation $(NiO)_{0.1563}(ZnO)_{0.3220}(MnO)_{0.0263}(CuO)_{0.0160}(Fe_2O_3)_{0.4793}$ was prepared using similar processing as set forth in Example No. 1 with the exception that the atomization occurred in a rotary atomization dryer and firing occurring at 1290° C. FIGS. 10 and 11 are SEM photomicrographs of this formulation and may be compared with the carriers of FIGS. 2, 3, 4 and 5. Measured test properties are listed in Table 3.

TABLE 3

Comparison of Bare Core Properties
Lithium Ferrite vs. Copper Zinc Ferrite and Nickel Zinc Ferrite

| Carrier Property Tested | Example 1 $(Li_2O)_{.1521}(Fe_2O_3)_{.8479}$ | Example 2 $(Li_2O)_{.145}(Fe_2O_3)_{.855}$ | Example 3 $(CuO)_{.20}(ZnO)_{.11}(Fe_2O_3)_{.69}$ | Example 4 $(CuO)_{.20}(ZnO)_{.25}(Fe_2O_3)_{.55}$ | Example 5 $(NiO)_{.1563}(ZnO)_{.3220}(MnO)_{.0263}(Fe_2O_3)_{.4793}$ |
|---|---|---|---|---|---|
| Hall Flow Meter Flow Rate (sec/50 g) | 25.4 | 26.1 | 25.5 | 24.3 | 24.0 |
| Apparent Density (g/cc) | 2.52 | 2.46 | 2.58 | 2.62 | 2.75 |
| BET Surface Area ($cm^3/g$) | 246 | 475 | 482 | 454 | 180 |
| Magnetic Saturation (4000 Oe Drive) (emu/g) | 60.0 | 46.4 | 41.8 | 65.5 | 47.7 |
| Resistivity @ 1000 Volts (ohm − cm) | $5.8 \times 10^9$ | $1.6 \times 10^9$ | $4.6 \times 10^8$ | $1.5 \times 10^8$ | $9.8 \times 10^8$ |
| Sieve Analysis: US Mesh | | | | | |
| +120 | 0.1 | 0.0 | 0.0 | 0.1 | 0.0 |
| +140 | 2.2 | 3.1 | 1.7 | 1.9 | 3.1 |
| +170 | 24.4 | 26.6 | 23.3 | 23.4 | 39.6 |
| +200 | 63.6 | 59.6 | 66.1 | 58.1 | 45.4 |
| +230 | 9.6 | 10.6 | 8.5 | 15.3 | 11.4 |
| +270 | 0.2 | 0.1 | 0.4 | 1.2 | 0.4 |
| +325 | 0.0 | 0.0 | 0.0 | 0.0 | 0.1 |
| −325 | 0.0 | 0.0 | 0.0 | 0.0 | 0.0 |
| Median Diameter Weight Dw 50% Microns | 83 | 83 | 83 | 81 | 84 |

Discussion of Examples

A ferrite carrier core material composition preferably has several attributes to permit its use as a reprographic or electrographic carrier core material. For example, it should have the ability to adjust magnetic moment, Ms, similar to the carriers of Examples No. 3 and No. 4 though, as described previously, the desired range of adjustment is about 30–65 emu/g. This permits utilization in various copy machine designs. The described non-stoichiometric lithium ferrite carrier permits similar variations as set forth in Table 1 and for Examples No. 1 and No. 2.

Figure 12:
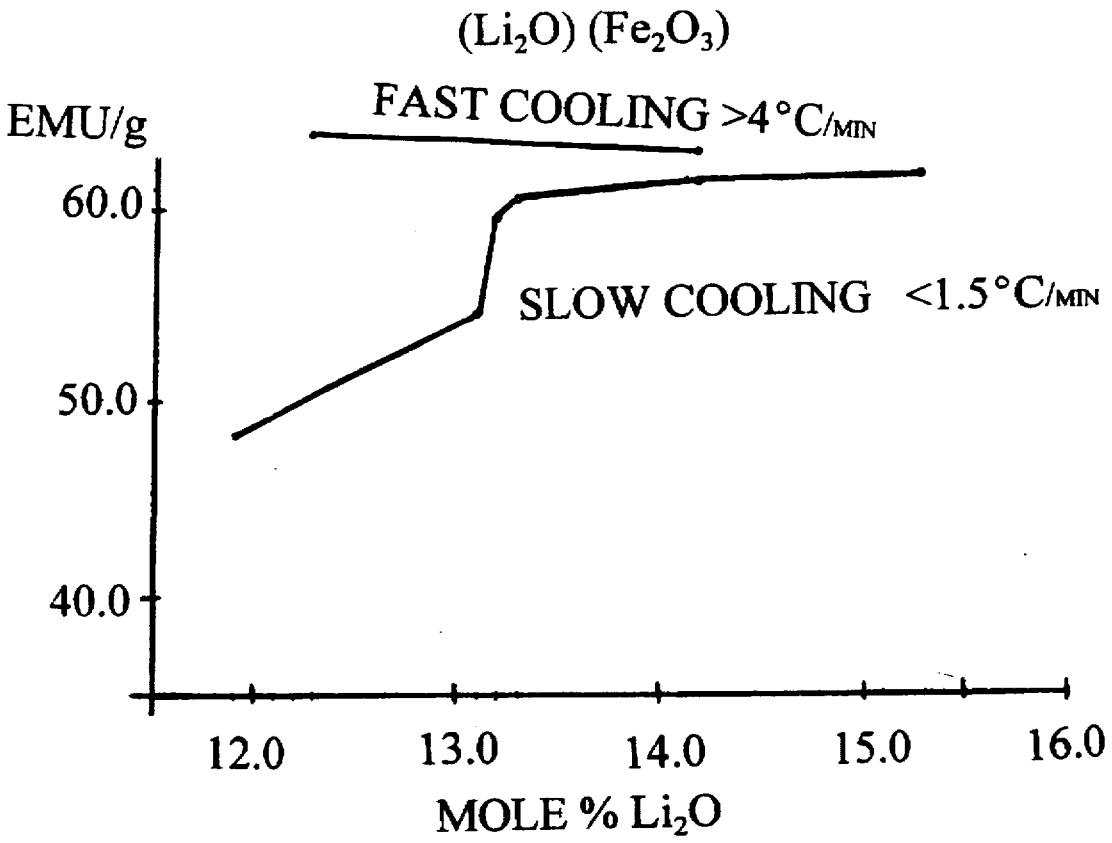
FIG. 12 is a graph depicting the impact of cooling rate during the manufacturing process of the invention.

Following in Table 4 and FIG. 12 is the result of testing magnetic saturation of various $Li_2O$ ferrite electrophotographic powders of the invention:

TABLE 4

| Composition of Ferrite Mole % of $Li_2O$ | Magnetic Saturation EMU/g Under Slow < 1.5° C./min Cooling | Magnetic Saturation EMU/g Under Fast > 4° C./min Cooling |
|---|---|---|
| 15.3 | 61.6 | — |
| 14.2 | 61.3 | 62.9 |
| 13.3 | 60.4 | — |
| 13.2 | 59.6 | — |
| 13.1 | 54.6 | — |
| 12.3 | — | 63.2 |
| 11.9 | 48.3 | — |

Referring to Table 4 and FIG. 12, the following is noted:

a) Magnetic saturation data with slow cooling of the material from a temperature of about 2150° F. on the phase diagram of the application (FIG. 1) results in a mixed spinel and hematite structure with a variable saturation range from about 48–61 emu/g depending upon specific composition. Slow cooling is defined as less than about 1.5° C./minute.

b) Fast cooling or quenching from such a temperature appears to produce higher, equal saturation values of about 63 emu/g. The spinel structure is retained in such a circumstance. Fast cooling is defined as about greater than 4° C./minute.

c) It is possible to custom design a carrier powder with a desired magnetic saturation (emu/g) dependent upon composition and cooling rate within the range desired and necessary to practice the invention as set forth in FIG. 1.

d) Also, the magnetic saturation data demonstrates, as set forth in Table 1 of the patent, that adequate saturation values are provided for use of the material as a carrier.

Tests determined triboelectric change rate for various compositions of the carrier comparing such data with standard Ni—Zn and Cu—Zn carriers. Changes in amount of charge were measured with a developer consisting of 930.0 g of a carrier and 70.0 g of a toner (for Mita DC-5685 copier) placed in a V blender of 1000 cc. The developer was agitated and stirred at 40 rpm. A blow-off charge measuring device, manufactured by Toshiba Chemical Co., was used to measure the amount of charge.

The changes in amount of charge in the durability test were measured by calculating the formula $(1-Y/X)\times 100(\%)$ wherein the charge amount (X) was obtained after five-minute agitation at 40 rpm under a high temperature and humidity (30° C., 80% RH) while the charge amount (Y) was obtained after 24-hours agitation at 40 rpm under just the same temperature and humidity as above.

These tests were conducted to demonstrate the stability of change of the powder as a carrier. Attached as Table 5 are the results of experimentation and the following is noted:

Referring to Table 5, it is desirable to maintain a low change rate. In the range of the non-stoichiometric material of the invention, the change rate is lower than the comparable rates for Ni—Zn and Cu—Zn powders. This indicates that the powder of the invention is more stable than the prior art carriers. The invention is thus believed superior or equal over the compositional range of the invention.

TABLE 5

| | Composition (mol %) | | | Rate of change between after agitation for 5 min. (X) and after for 24 hrs. (Y) |
|---|---|---|---|---|
| | $Li_2O$ | $Fe_2O_3$ | Coating | $(1 - Y/X) \times 100(\%)$ |
| Example 1 | 12.0 | 88.0 | non-coated | 27 |
| Ex. 2 | 13.3 | 86.7 | ↑ | 31 |
| Ex. 3 | 16.0 | 84.0 | ↑ | 58 |
| Ex. 4 | 16.7 | 83.3 | ↑ | 69 |
| Ex. 5 | 18.0 | 82.0 | ↑ | 79 |
| Ex. 6 | 20.0 | 80.0 | ↑ | 85 |
| Comparative Example 1 | Cu—Zn ferrite CuO = 20.0 ZnO = 25.0 $Fe_2O_3$ = 55.0 | | ↑ | 75 |
| Comparative Example 2 | Ni—Zn ferrite NiO = 15.63 ZnO = 32.20 $Fe_2O_3$ = 47.93 MnO = 2.63 CuO = 1.60 | | ↑ | 80 |
| Ex. 7 | 12.0 | 88.0 | MMA 1.0 wt % | 30 |
| Ex. 8 | 13.3 | 86.7 | ↑ | 37 |
| Ex. 9 | 16.0 | 84.0 | ↑ | 65 |
| Ex. 10 | 16.7 | 83.3 | ↑ | 75 |
| Ex. 11 | 18.0 | 82.0 | ↑ | 84 |
| Ex. 12 | 20.0 | 80.0 | ↑ | 88 |
| Comparative Example 3 | Cu—Zn ferrite CuO = 20.0 ZnO = 35.0 $Fe_2O_3$ = 55.0 | | ↑ | 80 |
| Comparative Example 3 | Ni—Zn ferrite NiO = 15.63 ZnO = 32.20 $Fe_2O_3$ = 47.93 MnO = 2.63 CuO = 1.60 | | ↑ | 87 |

Measurement Conditions = 30° C. × 80 RH %

Figure 13:
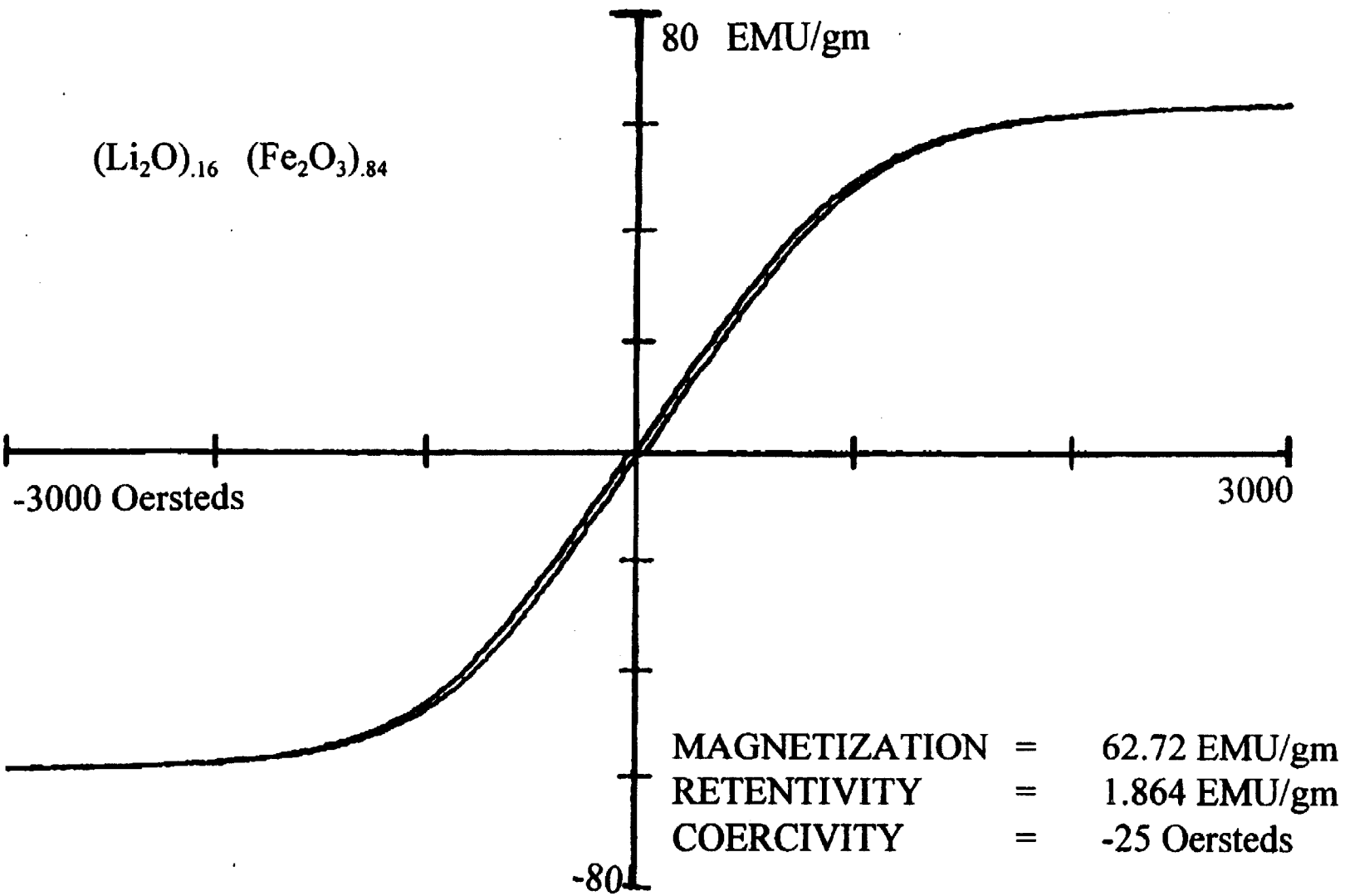
FIG. 13 is a graph depicting the change in magnetic saturation of the carrier of the invention with the change in field.
Figure 14:
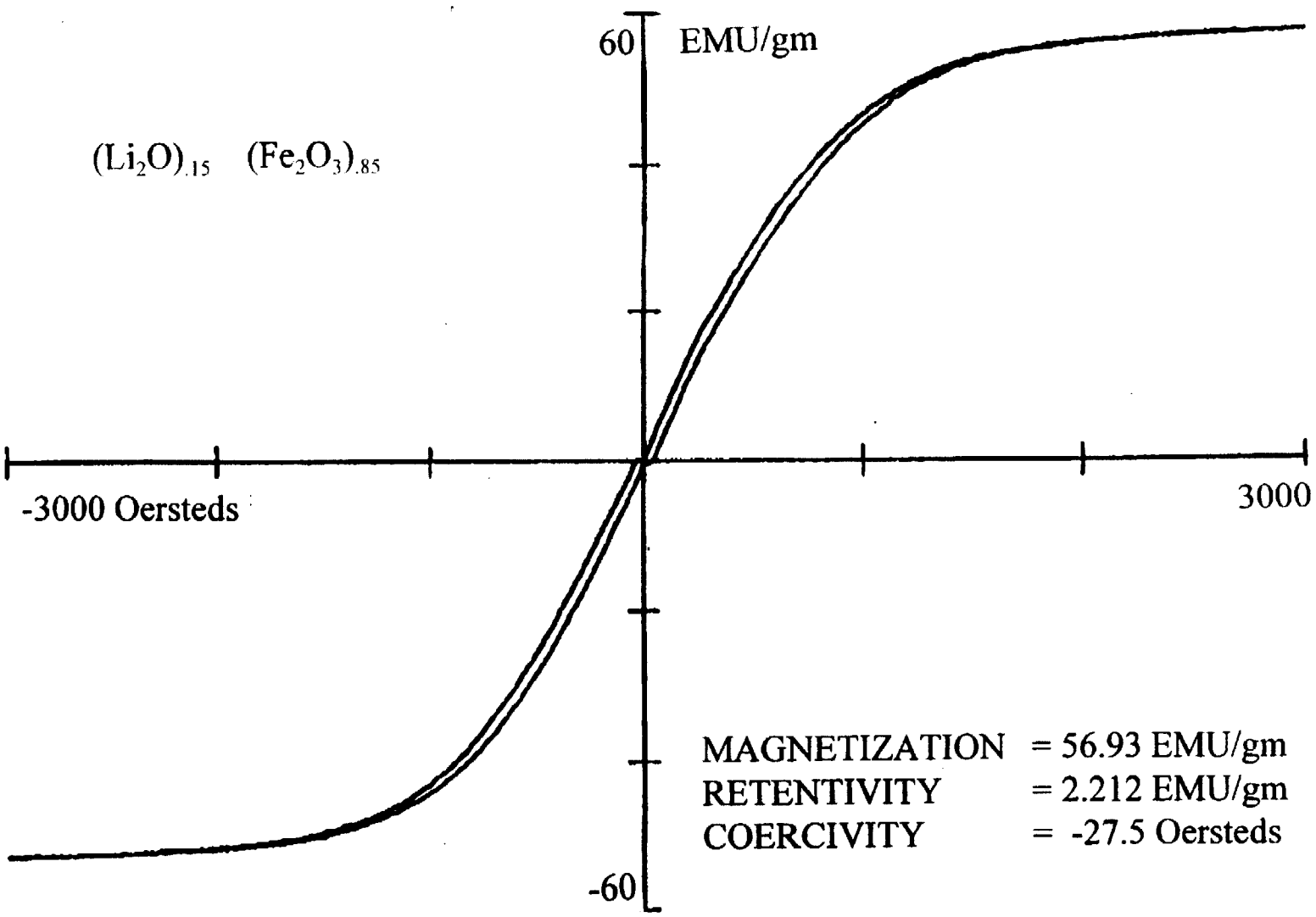
FIG. 14 is another graph depicting the change in magnetic saturation of the carrier of the invention with the change in magnetic field.

Further tests determined the presence or absence of a hysteresis pattern associated with a magnetic field applied to the powder of the invention. The results of such tests are attached as FIGS. 13 and 14 and the following is noted:

a) Referring to each graph, there is substantially no hysteresis associated with the carriers.

b) As such, the carriers would not be useful as a magnetic memory core.

Bulk densities should be similar to the existing ferrite core materials. The lithium ferrite carriers of the invention have a bulk density very similar to that of existing ferrite core materials. Also, by changing sintering temperatures and soak time at temperature, bulk density may be varied higher or lower depending on the desired value.

Flow rate determines the flow characteristics of a material in a copy machine magnetic brush developer station. The lithium ferrite composition of the invention has very similar flow characteristics to that of pre-existing ferrite carriers.

The sieve analysis of the carriers of the invention are in the preferred range of about −120 to +270 (U.S. Mesh).

Carrier core materials have either an acrylic, silicone, or fluoropolymer coating deposited on the carrier core surface to modify or enhance triboelectric or resistive properties for use with specific toners. For example, the following coatings are useful: polyethylene, polystyrene, polyvinyl acetate, poly methyl methacrylate, polyurethane, styrene methyl methacrylate, etc. The above list is illustrative only, and is not a limitation of this invention.

For a new ferrite composition to comprise an acceptable substitute for existing coating technologies, it is important for surface texture, as measured by BET surface area and visual observation by scanning electron microscopy, to show similar properties. Scanning electron microscopy analysis of Examples No. 1 through No. 5 demonstrates that the lithium ferrite carrier core of the invention is virtually indistinguishable from CuZn ferrite carrier core material and is similar to NiZn carrier core material. Comparison of BET surface area also shows very similar values. Also, BET surface texture may be modified by adjustment of soak time, temperature, and processing conditions used to formulate the carrier core. Thus, BET surface area values in the range of about 160–500 square centimeters per gram ($cm^2/g$) may be attained.

Section 66699 of the State of California Administrative Code, Title 22, Division 4 lists offending elements that are (per soluble threshold limit concentration (STLC) and total threshold limit concentration (TTLC) limits) classified as a hazardous waste. Thus, depending on the composition, firing conditions and stoichiometry, it is possible, if not likely, for ferrite materials containing Ni, Cu, and/or Zn to fail either one or both of these test limits, and therefore such carriers will be classified as a hazardous waste and subject to appropriate and expensive disposal procedures.

With the newly taught lithium ferrite material, offending elements are not present, and spent carrier materials may be classified as a benign waste. As such, they may be disposed or recycled very inexpensively.

Thus, the applicants manufacture of lithium ferrite materials which have a range of non-stoichiometric compositions and a spinel structure are deemed to be materials which are environmentally safe. That is, such materials can be utilized safely to provide a magnetic brush for the carrying of toner particles, and when the material is expended or no longer useful, it can be easily disposed without constituting an environmental hazard.

Various minor substitutions of constituents, additions of constituents and, of course, changes in the procedure for manufacture of the carrier are possible without departing from the spirit and scope of the invention. The invention is, therefore, to be limited only by the following claims and equivalents.

What is claimed is:

1. An environmentally benign, reprographic ferrite powder carrier for electrophotographic development consisting essentially of a non-stoichiometric, lithium ferrite powder having a composition within the compositional range represented by the formula:

$$\{(Li_2O)_{0.25}(Fe_2O_3)_{0.25}\}_x(Fe_2O_3)_{1.00-x}$$

where $0.35<x\leqq 0.50$ mole fraction and including $SiO_2$ or $Bi_2O_3$ or both within the powder composition as densifying and strengthening elements and a resin coating on the powder.

2. The ferrite powder carrier of claim 1 wherein lithium ferrite powder of the carrier comprises powder having a spinel crystalline structure.

3. The carrier of claim 1 wherein the carrier is a spherically shaped magnetic core carrier.

4. The carrier powder of claim 1 having dimensions with a sieve analysis range (U.S. Mesh) between about +120 and +270.

5. The carrier powder of claim 1 having a magnetic moment in the range of about 30–65 emu/g.

6. The carrier powder of claim 1 having a BET surface area in the range of about 160–500 $cm^2/g$.

* * * * *